US011602220B1

(12) United States Patent
Sagorski

(10) Patent No.: US 11,602,220 B1
(45) Date of Patent: Mar. 14, 2023

(54) FLEXIBLE HOOK HANGER FOR MOUNTING ON A CURVED SURFACE

(71) Applicant: Francis A. Sagorski, Traverse City, MI (US)

(72) Inventor: Francis A. Sagorski, Traverse City, MI (US)

( * ) Notice: Subject to any disclaimer, the term of this patent is extended or adjusted under 35 U.S.C. 154(b) by 0 days.

(21) Appl. No.: 17/678,111

(22) Filed: Feb. 23, 2022

(51) Int. Cl.

| | |
|---|---|
| ***A47B 96/06*** | (2006.01) |
| *A47F 5/08* | (2006.01) |
| *A47F 7/14* | (2006.01) |
| *A47G 25/06* | (2006.01) |

(52) U.S. Cl.
CPC ..... *A47B 96/067* (2013.01); *A47F 5/08* (2013.01); *A47F 5/0815* (2013.01); *A47F 7/143* (2013.01); *A47G 25/0607* (2013.01)

(58) Field of Classification Search
CPC ..... A47F 5/08; A47F 5/0815; A47F 5/0823; A47F 5/0876; A47F 7/143; A47G 25/06; A47G 25/0607; A47G 25/0635; A47B 96/067
USPC ..... 248/301, 303, 304, 339; 211/106.01
See application file for complete search history.

(56) References Cited

U.S. PATENT DOCUMENTS

| | | | | | |
|---|---|---|---|---|---|
| 327,939 | A | * | 10/1885 | Garrison | A47B 57/42 248/224.7 |
| 478,025 | A | | 6/1892 | Schraunder | |
| 1,350,632 | A | * | 8/1920 | Albrecht | A22B 5/06 248/307 |
| 1,800,387 | A | | 4/1931 | Greist | |
| 1,814,692 | A | | 7/1931 | Harris | |
| 1,848,937 | A | * | 3/1932 | Coventry | A47G 25/0678 248/223.41 |
| 2,611,492 | A | | 9/1952 | Watts | |
| 3,191,777 | A | * | 6/1965 | Willits, Jr. | A47F 5/0815 211/106.01 |
| 3,310,271 | A | * | 3/1967 | King | A47F 5/0815 248/222.52 |
| 3,516,634 | A | * | 6/1970 | Schafernak | A47B 96/061 211/106.01 |
| 4,658,967 | A | * | 4/1987 | Wang | A47G 25/0678 211/94.01 |
| 4,714,166 | A | * | 12/1987 | Hann | A47J 47/16 211/113 |
| 4,750,700 | A | * | 6/1988 | Wade | A47F 5/0823 248/303 |
| 4,768,660 | A | | 9/1988 | Handler et al. | |
| 5,101,989 | A | | 4/1992 | Jones | |
| 5,141,192 | A | * | 8/1992 | Adams | F21V 21/088 248/48.1 |
| 5,337,987 | A | | 8/1994 | Sawatsky | |

(Continued)

*Primary Examiner* — Devin K Barnett
(74) *Attorney, Agent, or Firm* — Peter Loffler

(57) ABSTRACT

A hook hanger supports hooks in either a vertical orientation, a horizontal orientation, or both. The hook hanger uses an elongate, relatively thin base strip is flexible so that it attaches to a surface, which surface may be flat, curved, 90-degree cornered, or a combination thereof. A mount strip, which is also flexible, overlays and is attached to an outer surface of the base strip. The mount strip has one or more openings along its length. A hook has a rearward and downward positioned bayonet so that the bayonet is inserted between the base strip and the mount strip either at an edge of the mount strip or through an opening on the mount strip.

12 Claims, 6 Drawing Sheets

(56) References Cited

U.S. PATENT DOCUMENTS 5,487,517 A * 1/1996 Smith ..... A47G 7/045 248/312.1
5,595,309 A * 1/1997 Bauer ..... A47F 5/0815 248/220.31
5,619,774 A * 4/1997 Perry ..... A45F 5/02 24/336
5,727,698 A * 3/1998 Lai ..... A47F 7/02 211/94.01
5,960,967 A 10/1999 Neil
6,119,878 A 9/2000 Zen
6,152,313 A 11/2000 Klein et al.
D438,448 S 3/2001 Batting et al.
D463,941 S 10/2002 Kerr
6,679,392 B1 1/2004 Costa
7,748,544 B1 7/2010 Davitz
7,757,869 B2 7/2010 Lawson
7,766,290 B1 8/2010 Bradbury
7,789,248 B1 * 9/2010 Salerno ..... A47G 25/08 211/106.01
8,066,130 B2 11/2011 Shaha et al.
8,308,116 B2 * 11/2012 Daniels ..... A47G 25/0678 211/106.01
8,511,485 B2 * 8/2013 Hernandez ..... A47F 5/0838 211/106.01
8,573,415 B2 11/2013 Ernst et al.
9,532,663 B2 * 1/2017 Nilsson ..... B25H 3/04
10,258,180 B2 4/2019 Malott et al.
10,724,677 B2 * 7/2020 Will ..... F16M 13/02
10,772,444 B2 9/2020 Stas
2008/0054142 A1 * 3/2008 Deland ..... A47F 5/0815 248/223.31
2010/0084530 A1 * 4/2010 Lai ..... A47G 25/0678 248/304
2012/0181244 A1 * 7/2012 Wang ..... A47G 25/0614 211/106.01
2019/0365100 A1 * 12/2019 Hansen, II ..... A47G 25/0678

* cited by examiner

FLEXIBLE HOOK HANGER FOR MOUNTING ON A CURVED SURFACE

BACKGROUND OF THE INVENTION

1. Field of the Invention

The present invention relates to a hanger strip that holds multiple hooks wherein the hooks can be oriented horizontally or vertically or both and wherein the hanger is flexible so as to allow the device to be attached to non-flat surfaces.

2. Background of the Prior Art

Hooks are extremely versatile and efficient tools. Hooks hold a wide variety of objects including such diverse items such as clothing, towels, keys, meats, paintings, tools, packaged items, jewelry, bags and baskets, cookware, and a whole host of other items. Like the items they hold, hooks also come in an array of styles, both functional and aesthetic, and also come in a wide variety of shapes and sizes.

Some hooks are standalone to hold a single item such as an item of art or a bathrobe. Such hooks tend to be attached directly to a surface, such as a wall surface, in appropriate fashion such as either piercing into the wall itself, such as with a wall anchor or a screw, or via an adhesive, either directly or via an intermediary device such as cooperating hook and loop materials. Some standalone hooks may be supported from above such as in an assembly plant where large items may be moved from one area of the facility to another via an overhead hook that slides upon an appropriate rail.

Some hook systems have a series of hooks that are ganged in a fixed array such as a plate member that has a series of spaced apart hooks (often, but not always spaced apart equidistantly) that may be used to hold towels in a bathroom or keys by the front door, for example. Typically, such hook arrangements tend to be secured into a target surface such as a wall via a screw or nail, or via a wall hanger.

Other systems that gang hooks together use a rail system wherein a hook assembly has a base that is received within the rail system's channel and slides therein and is positioned along the length of the rail as desired. A locking system is employed to hold each hook in its desired location. Many rail hook systems have hooks that can be rotated with respect to the hook's base. This allows the hook to be turned from horizontal to vertical as desired. While allowing versatility in permitting hook orientation change, such hook systems tend to be complicated in their rotation systems, making such systems unnecessarily expensive.

Some hooks use a pegboard board mount system that allows positioning of various sized hooks in multiple configurations. Pegboards allow hooks to be mounted in either horizontal or vertical fashion within a single board. However, pegboards are very utilitarian in appearance and their location tends to be relegated to the garage or work shed.

Additionally, multiple hook systems use a base that is some form of a plate member such that its wall contacting surface is substantially flat in order to correspond to the surface upon which the device is mounted.

While each of these hook systems, and others, are very functional and serve very useful purposes, there is room for improvement in the art of hooks. Specifically, a system is needed that allows a hook system to be positioned so that it's onboard hooks can to be oriented both horizontally and vertically or both within the same system which rotation system is simple in design and is attractive. Additionally, it is often desirable to mount ganged hooks onto a curved surface such as a round post or a curved wall within a house or commercial facility or even on a corner of a wall or other mount surface. Currently, individual hooks must be mounted independent of one another. This is time-consuming, especially if a person desires equidistant spacing of the hooks about the curved surface and lacks the aesthetic additions provided by a hook holding base.

Accordingly, there is a need in the art for a hook system that holds multiple hooks in either horizontal orientation, vertical orientation, or both without the complexity of current multi-orientation hook systems and without the utilitarian appearance of a pegboard system. Such a hook system must be mountable on a surface that is curved, either inwardly or outwardly or both, or that is located at a corner of the intended mount surface, yet where the hook system is quickly and easily mountable onto the surface.

SUMMARY OF THE INVENTION

The flexible hook hanger for mounting on a curved surface addresses the aforementioned needs in the art by providing a system that holds multiple hooks where the hooks can be oriented either horizontally or vertically or both within the single system. The change of orientation of a given hook does not rely on the use of moving parts so as to simplify the orientation change process. The flexible hook hanger for mounting on a curved surface can be quickly and easily attached to either an inwardly curved or outwardly curved surface quickly and easily, such curved surfaces include corners. Multiple hook styles and sizes can be used with the flexible hook hanger for mounting on a curved surface. The flexible hook hanger for mounting on a curved surface is of relatively simple design and construction, being produced using standard manufacturing techniques, so as to make the device relatively inexpensive to produce so as to be economically attractive to potential consumers of this type of device.

The flexible hook hanger for mounting on a curved surface of the present invention is comprised of a base strip that has a first front surface and a first back surface. The base strip is an elongate member made from a first flexible material. A mount strip has a second front surface and a second back surface. The mount strip is also an elongate member made from a second flexible material, which may be the same as the first material. The mount strip has at least one opening located along its length. The mount strip is attached to the base strip such that the second back surface of the mount strip faces and abuts the first front surface of the base strip. A hook has a main leg with an upper portion and a lower portion with the lower portion of the main leg leading to a hook portion. The hook also has a bayonet extending downwardly from the main leg, proximate the upper portion of the main leg, such that a gap exists between the bayonet and a section of the main leg. The hook is attached to the attached base strip—mount strip combination by passing the bayonet either through the opening on the mount strip or between the base strip and the mount strip so that a portion of the mount strip is located within the gap of the hook. The base strip and the mount strip may each be made from the group comprising a soft, flexible plastic, a cloth, neoprene, and leather, or other similar material. The mount strip may be attached to the base strip via tacks that pass through both strips, via cooperating hook and loop material sections, via stitching that passes through the mount strip and the base strip, or other appropriate attachment mechanism.

BRIEF DESCRIPTION OF THE DRAWINGS

Similar reference numerals refer to similar parts throughout the several views of the drawings.

DESCRIPTION OF THE PREFERRED EMBODIMENT

Figure 1:
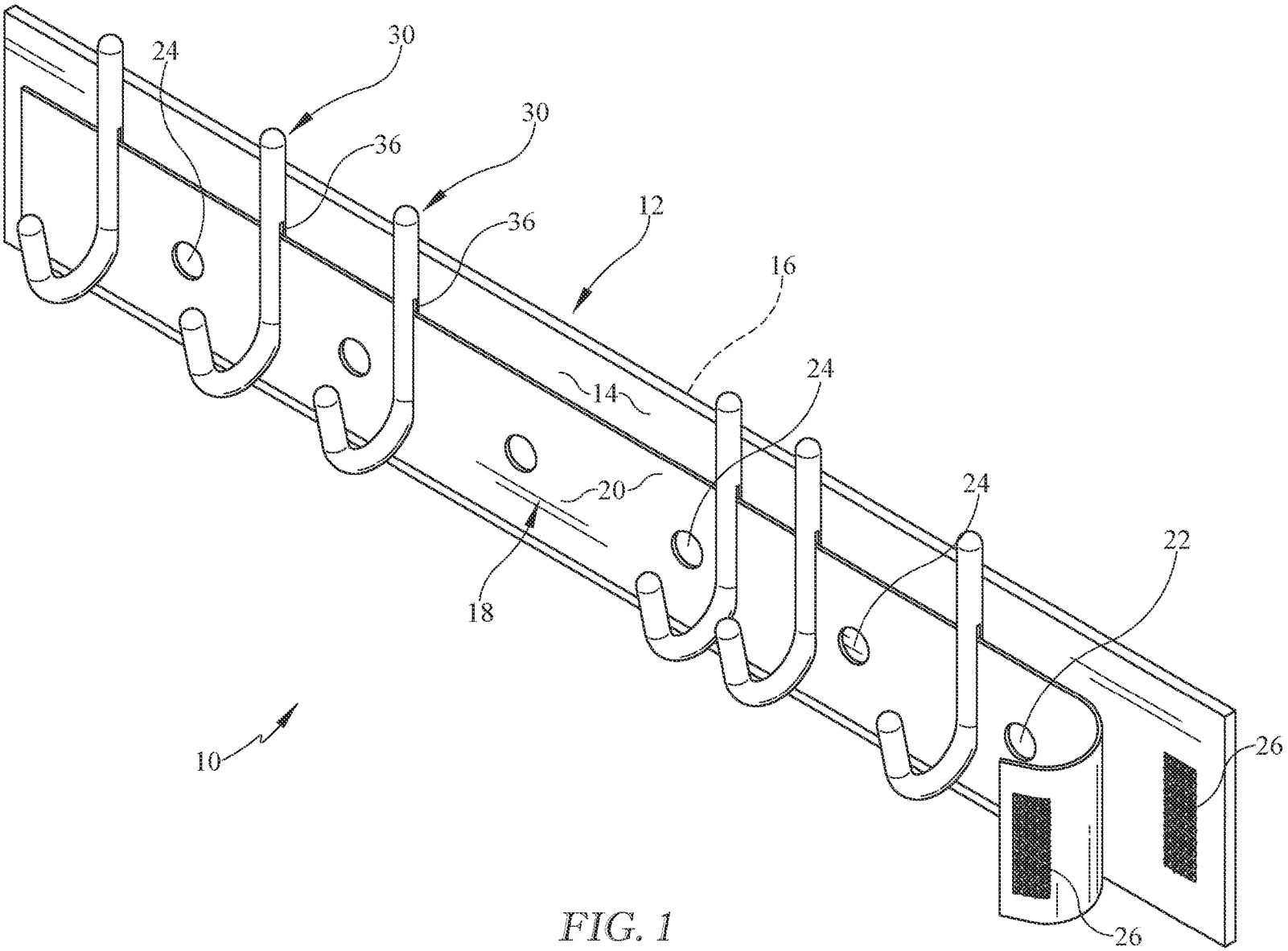
FIG. 1 is a perspective view of the flexible hook hanger for mounting on a curved surface of the present invention with the hooks oriented vertically and using cooperating hook and loop material to attached the mount strip to the base strip.
Figure 2:
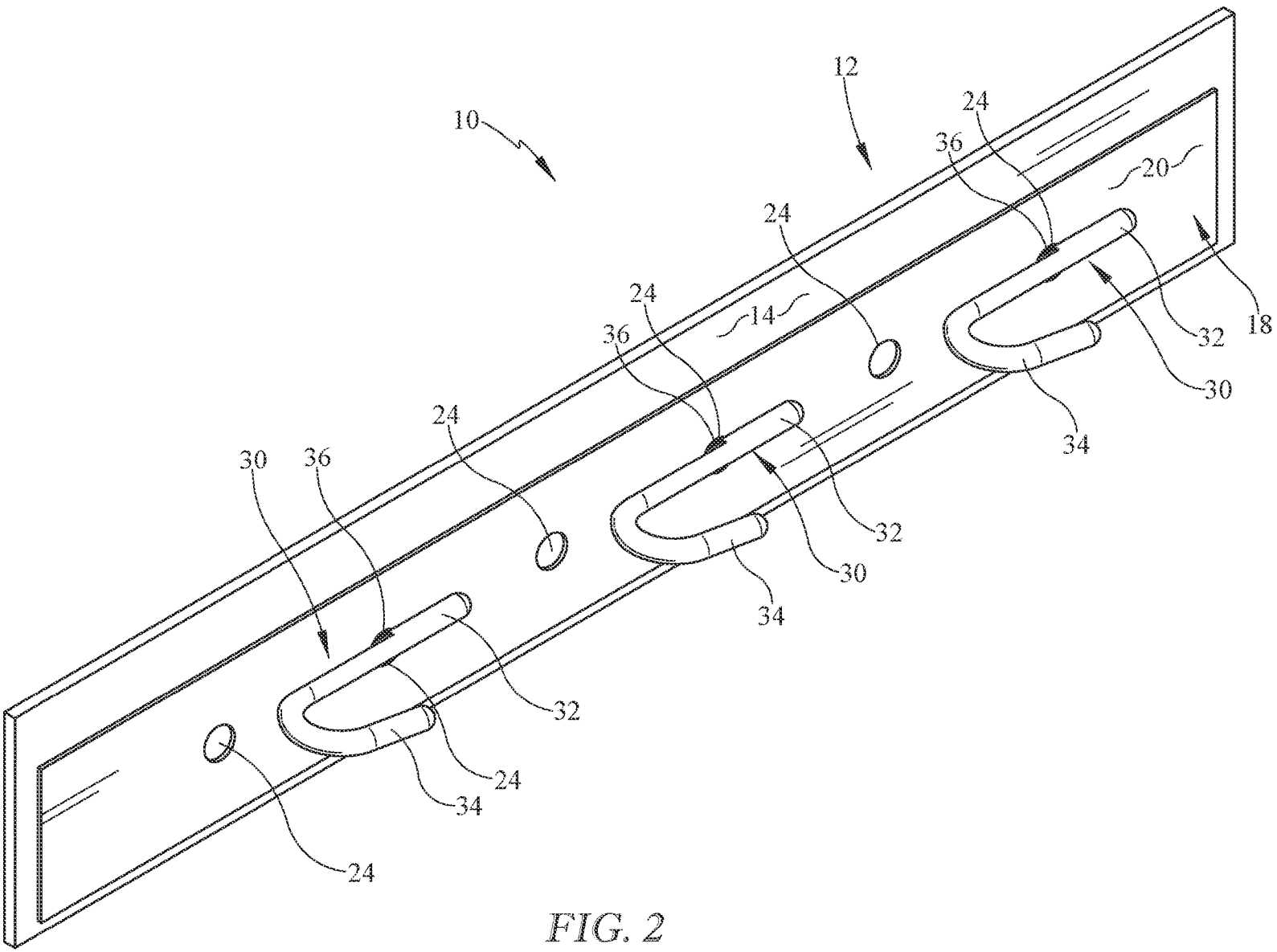
FIG. 2 is a perspective view of the flexible hook hanger for mounting on a curved surface with the hooks oriented horizontally.
Figure 3:
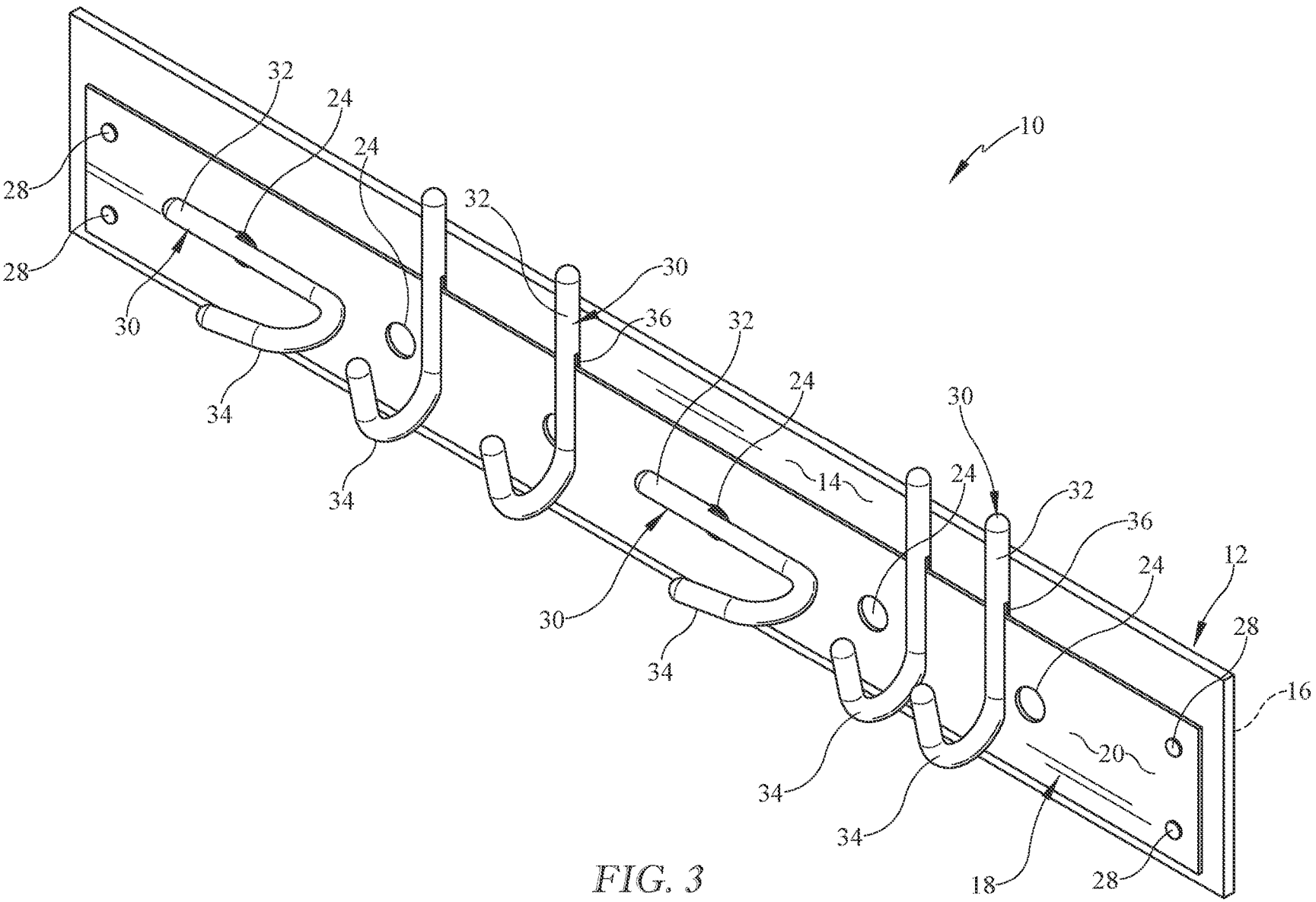
FIG. 3 is a perspective view of the flexible hook hanger for mounting on a curved surface with the hooks oriented both vertically and horizontally and using tacks to attached the mount strip to the base strip.
Figure 4:
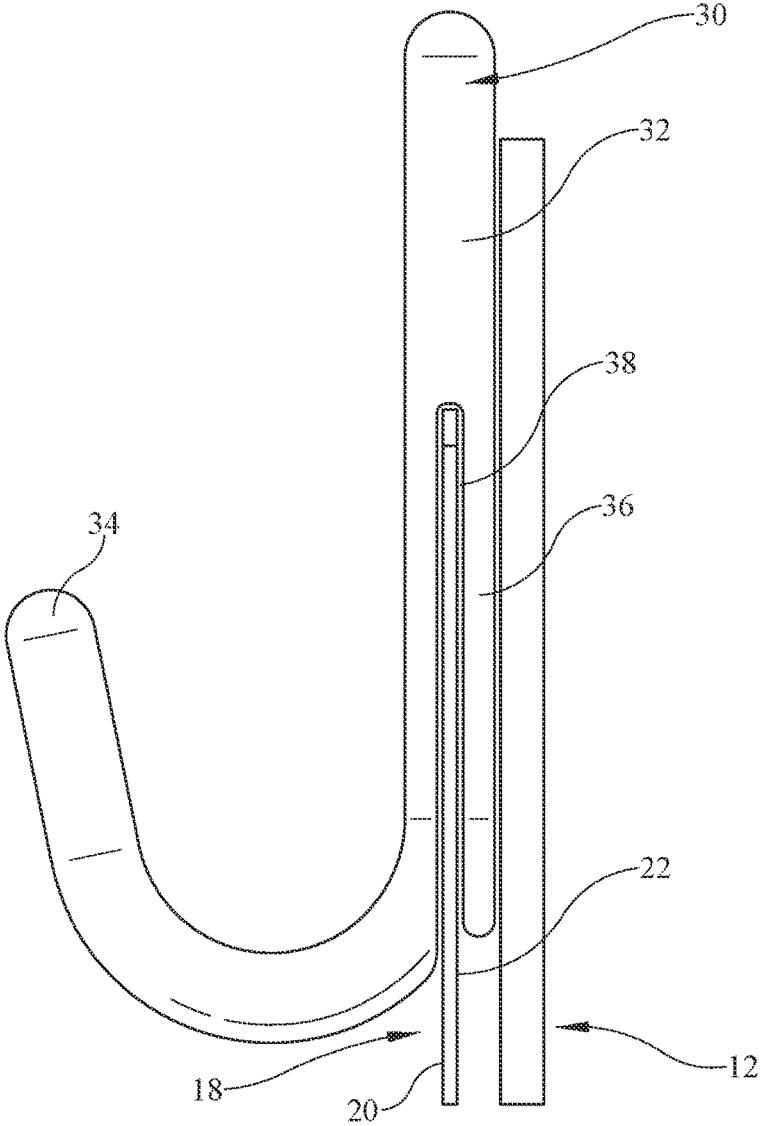
FIG. 4 is a side view of the flexible hook hanger for mounting on a curved surface with vertically oriented hook.
Figure 5:
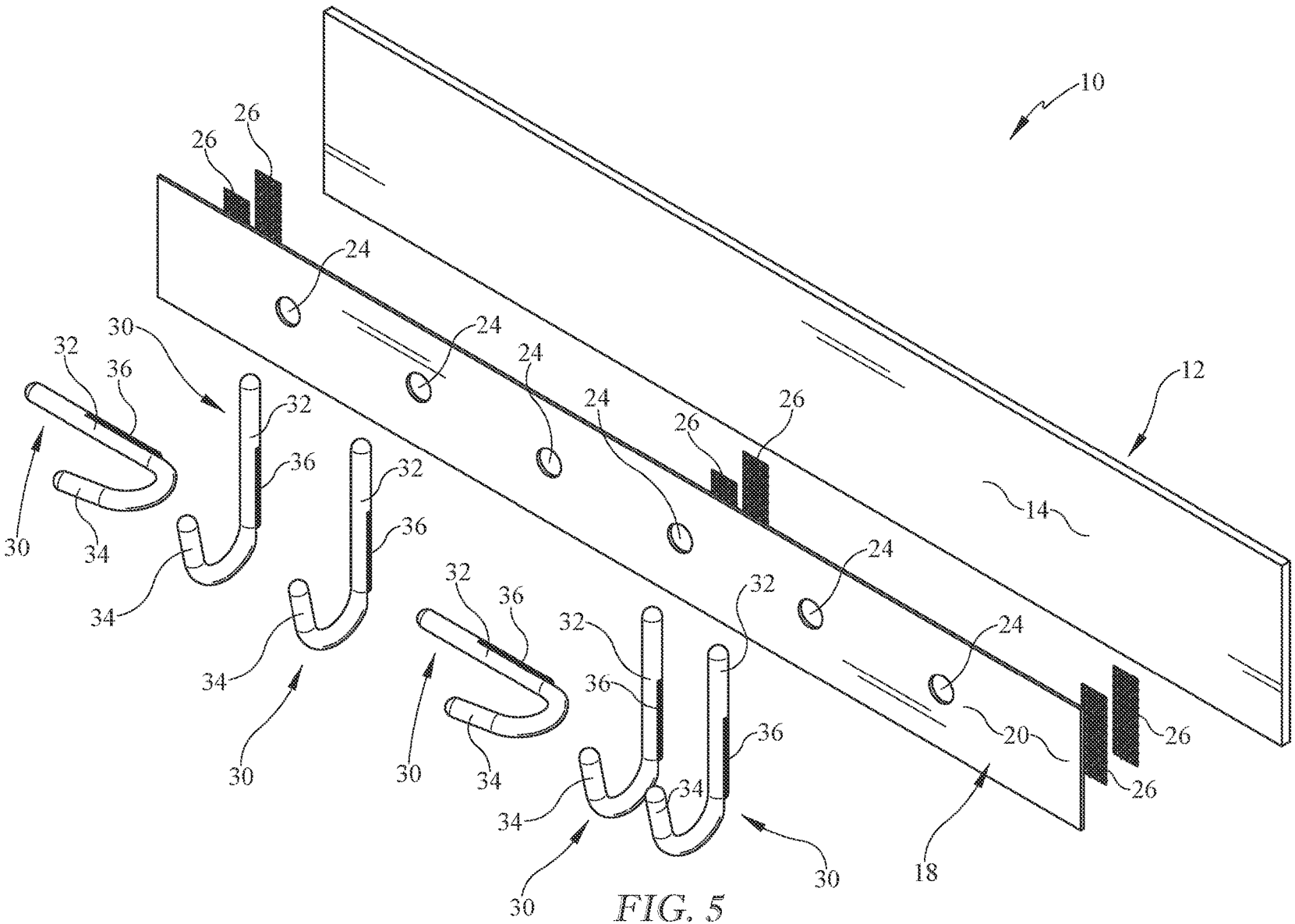
FIG. 5 is an exploded perspective view of the flexible hook hanger for mounting on a curved surface.

Referring now to the drawings, it is seen that the flexible hook hanger for mounting on a curved surface of the present invention, generally denoted by reference numeral 10, is comprised of base strip 12 that is an elongate, substantially flat, generally rectangular member made from a flexible material such as flexible plastic (such as low-density polyethylene, high-density polyethylene, polypropylene, etc.), canvas or other clothes, neoprene, etc. The base strip 12 has a first front surface 14 and a corresponding first back surface 16. The base strip 12 is attached to a target surface, such as a wall or a post by placing the first back surface 16 of the base strip 12 against the mount surface and using an appropriate attachment device, such as nails or screws, adhesive, etc., to secure the base strip 12 to the mount surface.

A mount strip 18 is also an elongate, substantially flat, rectangular member that is made from the same or similar material used to make the base strip 12 and is advantageously, either the same size as the base strip 12 or slightly smaller. The mount strip 18 has a second front surface 20 and a corresponding second back surface 22. A series of openings 24 is located along the mount strip 18 in spaced apart fashion. Depending on the height of the mount strip 18, more than one row of openings can be provided and the openings need not be equidistantly spaced apart from one another.

The base strip 12 and mount strip 18 can have any desired aesthetic layout, limited only by the creativity of the designer.

The mount strip 18 is overlaid atop the base strip 12 such that the second back surface 22 of the mount strip 18 is positioned against the first front strip 14 of the base strip 12. The mount strip 18 is attached to the base strip 12 in appropriate fashion such as via corresponding cooperating hook and loop sections 26 located on the first front strip 14 of the base strip 12 and the second back surface 22 of the mount strip 18 and mating the two strips 12 and 18 to one another. The hook and loop sections 26 can run longitudinally, latitudinally or both (of course can be either section can be round or square in shape). Alternately, a series of tacks 28 can be used to secure to mount strip 18 to the base strip 12—the tacks 28 can serve the dual purpose of attaching the mount strip 18 to the base strip 12 and also attached the two combined strips 12 and 18 to the intended mount surface. Other attachment methods can also be used depending on the materials used to make the base strip 12 and the mount strip 18 such as adhesion, ultrasonic welding, stitching, etc., with appropriate gaps located as needed as more fully described below.

A series of hooks 30 is provided such that each hook 30 has a main leg 32 leading to a hook leg 34. A bayonet 36, which may be pointed or rounded on its distal end, extends downwardly from an upper portion of the main leg 32 such that a gap 38 exists between a lower part of the main leg 32 and the bayonet 36. The hooks 30 are attached to the attached mount strip 18 and base strip 12 by either inserting the hook's bayonet 36 between the slight gap between the mount strip 18 and the base strip 12 for a vertical orientation (the terms vertical and horizontal being used for relative orientation purposes only). If the desired hook 30 placement is at a spot where the hook and loop sections 26 are located, then the bayonet 36 is pushed through the point of attachment of the hook and loop sections 26 so as to form a slight gap that allows the bayonet 36 to pass therethrough. Alternately, the hook 30 can be mounted horizontally by passing the bayonet 36 through one of the openings 24 on the mount strip 18, again loosening a portion of hook and loop sections 26 if needed—if the bayonet 36 is pointed or at least rounded at its tip, the tip helps the separation of the mated hook and loop sections 26. Of course, the hooks 30 can be mounted vertically via the openings 24 on the mount strip 18. In any case, a portion of the mount strip 18 is located within the gap 38 of the hook 30 with an edge of the mount strip 18 (either a side or end edge or an edge portion of an opening 24 resting at the joinder of the hook leg 34 and the bayonet 36.

The hooks 30 are made from any appropriate material, such as plastic, aluminum, steel, etc.

Figure 6:
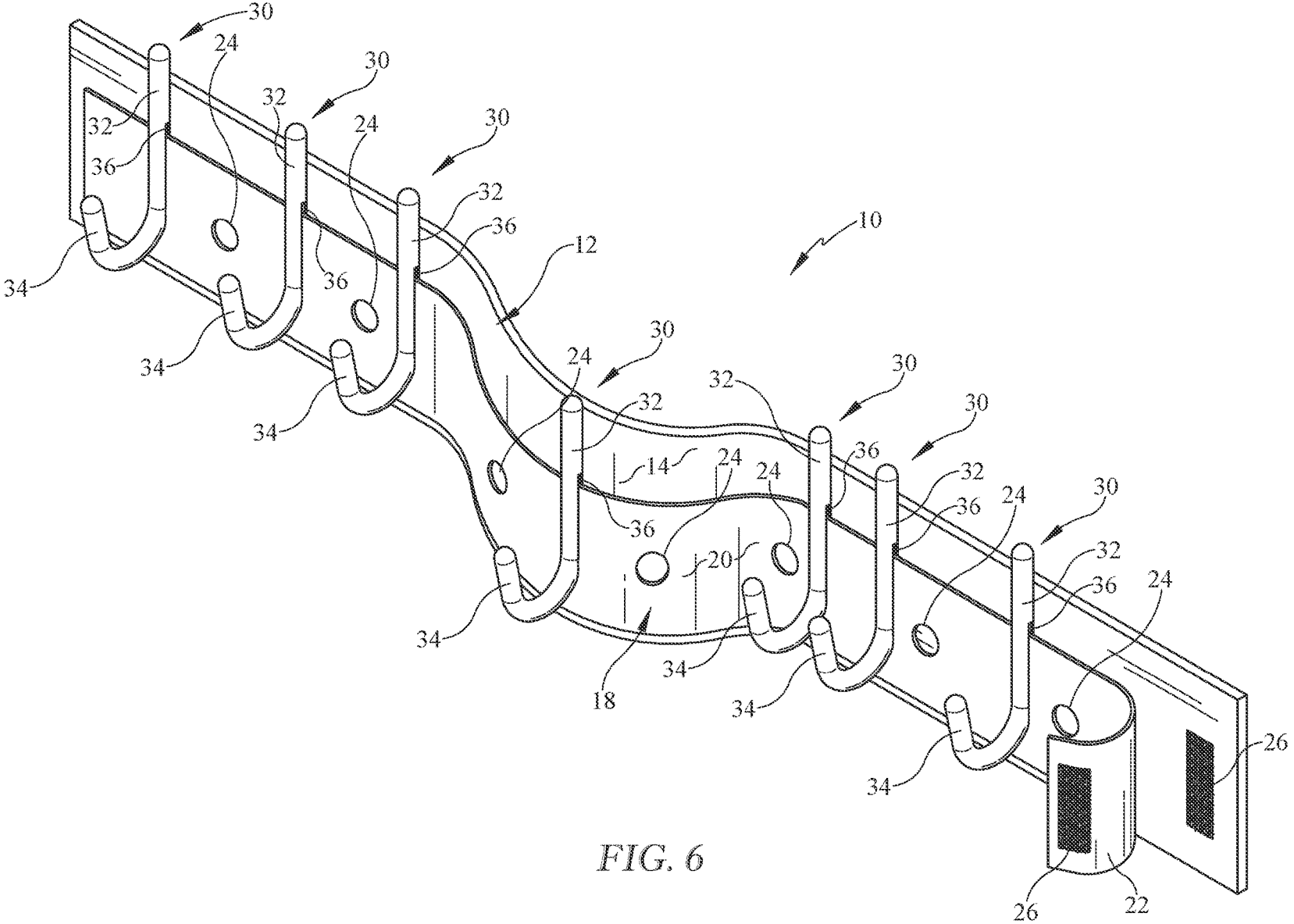
FIG. 6 is a perspective view of the flexible hook hanger for mounting on a curved surface illustrating the flexibility of the mount strip and the base strip.

In order to use the flexible hook hanger for mounting on a curved surface 10 of the present invention, the base strip 12 is attached to a desired mount surface, which may but need not be flat. As seen in FIG. 6, as the base strip 12 and the mount strip 18 are each made from a flexible material, then the mount surface may be partially or completely curved or wavey (non-flat). The base strip 12 and mount strip 18 can also be attached around a 90-degree corner if desired. Of course, the two strips 12 and 18 can be attached to a thin vertical mount surface such as a support post or fence post. The base strip 12 is attached to the mount surface as desired. Either the mount strip 18 is attached to the base strip 12 via tacks 28 that pass through the two strips 12 and 18 and attach them to one another and to the mount surface or the base strip 12 is attached to the mount surface as desired and thereafter the mount strip 18 is attached to the base strip 12 either via the tacks 28 or via the hook and loop sections 26 as described. Once the base strip 12 and the mount strip 18 are attached to the mount surface, hooks 30 are positioned as desired and used as needed. The attachment of the mount strip 18 to the base strip 12 is sufficiently tight so as to prevent the hooks 30 from sagging due to mount strip 18 sag. If a "continuous" attachment method is used to attach the mount strip 18 to the base strip 12, such as stitching, adhesion, ultrasonic welding, etc., appropriate gaps are positioned through the two strips 12 and 18 to allow positioning of the hooks 30, both horizontally and vertically, the gaps being sufficiently wide so as to allow the bayonet 36 of the hooks 30 to pass therethrough. Of course, more than one style of hooks can be used with the present invention.

If a different hook 30 layout is desired, such as using a mount strip that has more than one row of openings, then the original mount strip 18 is detached from the base strip 12 and a new mount strip is attached to the base strip 12 in appropriate fashion.

While the invention has been particularly shown and described with reference to an embodiment thereof, it will be appreciated by those skilled in the art that various changes in form and detail may be made without departing from the spirit and scope of the invention.

I claim:

1. A hook hanging system comprising:

a base strip having a first front surface and a first back surface, the base strip being an elongate member made from a first flexible material, wherein the base strip is configured to be mounted to a support structure;

a mount strip having a second front surface and a second back surface, the mount strip being an elongate member made from a second flexible material, the mount strip having at least one opening, the mount strip attached to the base strip such that the second back surface of the mount strip faces and abuts the first front surface of the base strip; and a hook having a main leg with an upper portion and a lower portion, the lower portion of the main leg leads to a hook leg, the hook also having a bayonet extending downwardly from the main leg, proximate the upper portion, such that a gap exists between the bayonet and a section of the main leg, the hook is configured to be attached to the base strip and the mount strip by passing the bayonet either through the opening on the mount strip so that the bayonet is between the mount strip and the base strip or by inserting the bayonet in a gap between the base strip and the mount strip so that a portion of the mount strip is located within the gap of the hook.

2. The hook hanging system as in claim 1 wherein the first flexible material and the second of flexible material are the same.

3. The hook hanging system as in claim 1 wherein the base strip and the mount strip are each made from a soft, flexible plastic.

4. The hook hanging system as in claim 1 wherein the base strip and the mount strip are each made from a cloth.

5. The hook hanging system as in claim 4 wherein the cloth is canvas.

6. The hook hanging system as in claim 1 wherein the base strip and the mount strip are each made from neoprene.

7. The hook hanging system as in claim 1 wherein the base strip and the mount strip are each made from leather.

8. The hook hanging system as in claim 1 wherein the base strip and the mount strip are each made from a material consisting of a flexible plastic, a cloth, neoprene, or leather.

9. The hook hanging system as in claim 1 wherein the mount strip is attached to the base strip via cooperating hook and loop materials.

10. The hook hanging system as in claim 1 wherein the mount strip is attached to the base strip via a series of tacks that are configured to pass through the mount strip and the base strip in spaced apart fashion.

11. The hook hanging system as in claim 1 wherein the mount strip is attached to the base strip via a stitching that is configured to pass through the mount strip and the base strip.

12. The hook hanging system as in claim 1 wherein the mount strip is attached to the base strip via cooperating hook and loop materials, via a series of tacks that are configured to pass through the mount strip and the base strip in spaced apart fashion, or via stitching that is configured to pass through the mount strip and the base strip.

* * * * *